US006835011B2

(12) United States Patent
Hirano

(10) Patent No.: US 6,835,011 B2
(45) Date of Patent: Dec. 28, 2004

(54) IMPACT DOT PRINTING HEAD CONTROL APPARATUS

(75) Inventor: Takahisa Hirano, Tagata-gun (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/376,240

(22) Filed: Mar. 3, 2003

(65) Prior Publication Data

US 2004/0175219 A1 Sep. 9, 2004

(51) Int. Cl.[7] ..... B41J 2/22

(52) U.S. Cl. ..... 400/124.01; 400/124.05; 400/157.3

(58) Field of Search ..... 400/124.01–124.07, 400/54–55, 157.2, 157.3, 166; 101/93.04–93.1

(56) References Cited

U.S. PATENT DOCUMENTS 4,448,553 A * 5/1984 Yonezawa et al. ..... 400/279
4,597,328 A * 7/1986 Carrington et al. ..... 101/93.13
5,186,550 A * 2/1993 Koike ..... 400/54
5,330,277 A * 7/1994 Kasai et al. ..... 400/157.3
5,468,076 A 11/1995 Hirano et al. ..... 400/59

FOREIGN PATENT DOCUMENTS

JP 2878433 4/1999

* cited by examiner

*Primary Examiner*—Minh Chau
(74) *Attorney, Agent, or Firm*—Oblon, Spivak, McClelland, Maier & Neustadt, P.C.

(57) ABSTRACT

With an impact dot printing head control apparatus according to the invention, the drive control of respective wires is implemented on the basis of a normal fire and a pre-fire by generating the normal fire for driving the respective wires of the impact dot printing head so as to reach a printing position on the basis of printing data and a driving frequency of the impact dot printing head, and by generating, prior to the normal fire, the pre-fire for driving the respective wires so as not to reach the printing position. As a result, since the respective wires are caused to move by the pre-fire before actual printing operation by the normal fire even without preparing a large power source so as to meet requirements for driving the respective wires at the time of low temperature, the performance of the impact dot printing head can be ensured even at the time of low temperature, and in addition, reduction in product cost and downsizing of a product can be implemented.

18 Claims, 14 Drawing Sheets

IMPACT DOT PRINTING HEAD CONTROL APPARATUS

BACKGROUND OF THE INVENTION

1. Field of the Invention

The present invention relates to an impact dot printing head control apparatus for driving an impact dot printing head.

2. Discussion of the Background

An impact dot printing head is a device for printing by causing armatures linked with wires for printing, respectively, to rock between a printing position and a standby position, and by causing the respective tips of the wires to collide against a printing medium such as paper for printing when the armatures are caused to rock to the printing position. The impact dot printing head is provided with a plurality of the armatures. Consequently, there exist as many wires as the armatures. The number of the wires, in common and widespread use at present, is from 24 to 48.

The characteristics of the impact dot printing head, such as impact force, the maximum response frequency, and so forth, change depending on a use environment. In particular, in case the use environment is at low temperature, there can be a case where the wire in printing operation is subjected to considerable resistance caused by a lubricant, such as grease etc., applied between wire guides supporting the wire and the wire. As a result, impact force characteristics undergo a change. Accordingly, various methods have so far been proposed as a method of driving the impact dot printing head. For example, with a method disclosed in Japanese Patent Publication No. 2878433, a given impact force is obtained by rendering a driving condition variable in response to variation in temperature with the use of impact force variable means in order to ensure the performance of an impact dot printing head against variation in temperature. In particular, under conditions where the performance of the impact dot printing head deteriorates, large energy is applied to the impact dot printing head temporarily with the use of the impact force variable means.

In the case of ensuring the performance of the impact dot printing head by rendering, for example, current variable as in the past, the wire is driven by supplying current at 1.2 A per one wire at the time of normal temperature, and at 1.4 A per one wire at the time of low temperature. Accordingly, in the case of the impact dot printing head having 48 wires, an instantaneous current value will be 57.6 A at the time of normal temperature, and 67.2 A at the time of low temperature, resulting in a difference of as much as 9.6 A. Consequently, a large power source needs to be prepared to meet requirements for driving the wires at the time of low temperature. Further, the specification of driver elements for the impact dot printing head also needs to be enlarged. As a result, there will be an increase in product cost, and it has been difficult to implement downsizing of a product.

SUMMARY OF THE INVENTION

It is therefore an object of the invention to implement reduction in product cost and downsizing of a product while ensuring the performance of an impact dot printing head even at the time of low temperature.

The object of the invention is attained with a novel impact dot printing head control apparatus according to the invention.

Accordingly, in the novel impact dot printing head control apparatus according to the invention, a normal fire is generated which drives respective wires of the impact dot printing head so as to reach a printing position on the basis of printing data and a driving frequency of the impact dot printing head, and prior to the normal fire, a pre-fire is generated which drives the respective wires so as not to reach the printing position, whereby the drive control of the respective wires is implemented on the basis of the normal fire and the pre-fire.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

A first embodiment of an impact dot printing head control apparatus according to the invention is described hereinafter with reference to FIGS. 1 through 3.

Figure 1:
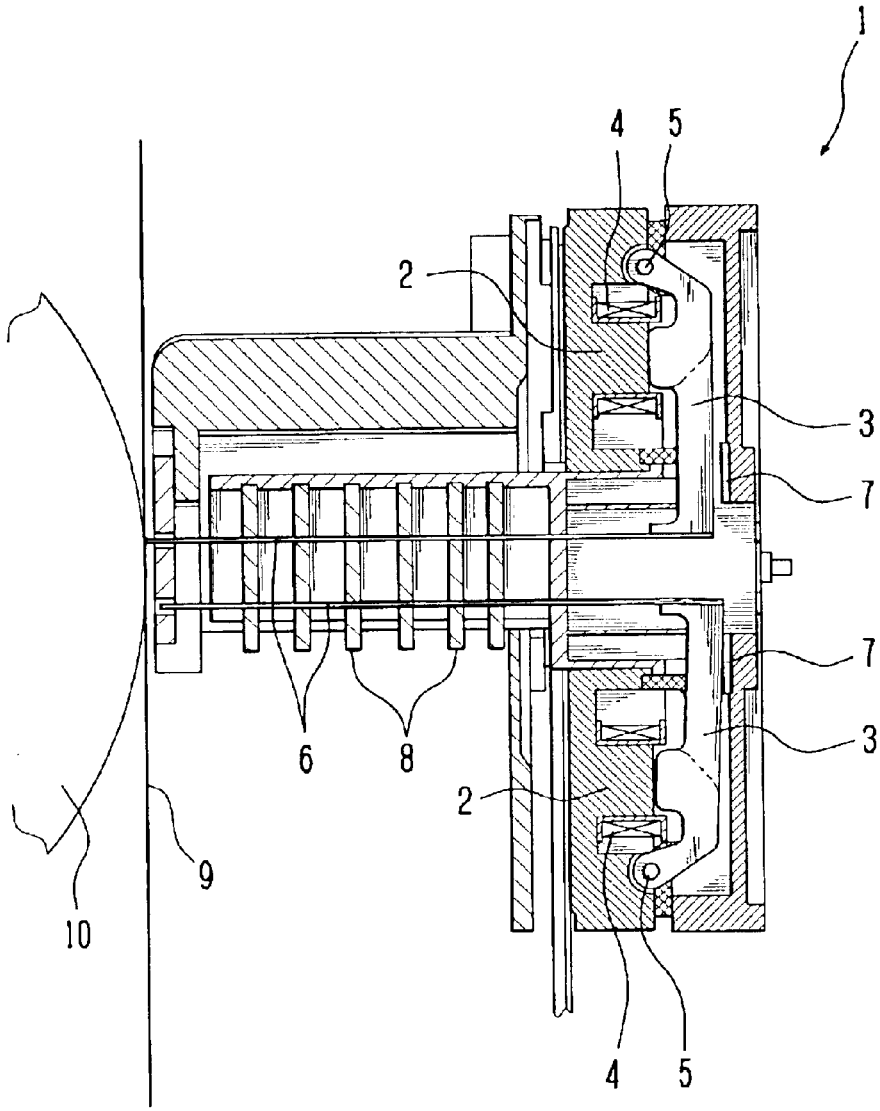
FIG. 1 is a front view in longitudinal section, schematically showing the central part of an impact dot printing head.

FIG. 1 is a front view in longitudinal section, schematically showing the central part of the impact dot printing head 1. The impact dot printing head 1 is provided with a plurality of cores 2 annularly arranged, and a plurality of armatures 3 disposed so as to oppose the cores 2, respectively. The plurality of the cores 2 are provided with a coil 4 wound around them, respectively. Accordingly, the cores 2 together with the coils 4 each constitute an electromagnet.

Respective base end parts of the armatures 3 are attached to respective support spindles 5, and the armatures 3 are constructed so as to be freely rockable around the respective support spindles 5. A wire 6 for printing is fixedly attached to the respective tips of the armatures 3. The respective armatures 3 are urged to move in a direction (the direction of the arrow in FIG. 1), opposite to a direction for printing, by urging members (not shown), such as a spring, and so forth, to be stopped by respective stoppers 7, thereby standing by at a standby position. That is, the stoppers 7 abut against the armatures 3, respectively, thereby determining the respective standby positions of the armatures 3.

Further, the impact dot printing head 1 is provided with wire guides 8 for slidably supporting the respective wires 6. A lubricant such as grease is applied to contact faces between the respective wires 6 and the wire guides 8 in order to enhance wire slidableness.

With the impact dot printing head 1 described above, the armatures 3 are magnetically attracted to the respective cores 2 by energization of the respective coils 4, and are caused to rock around the respective support spindles 5. When the respective armatures 3 are caused to rock towards a printing position from the standby position thereof, the respective wires 6 as well move from a standby position to a printing position thereof, whereupon the tips of the respective wires 6 abut against a platen 10 through the intermediary of a printing medium 9. Thus, printing on the printing medium 9 is implemented. Then, upon deenergizxation of the respective coils 4, generated magnetism will disappear, whereupon the respective armatures 3 are caused to rock towards the standby position by the urging of the urging members, and abut against the stopper 7, thereby coming to a stop at the standby position.

Since the constitution of an impact dot printer (not shown) having the impact dot printing head 1 is well known, only the principle thereof is briefly described. The impact dot printing head 1 is mounted on a carriage (not shown) that is reciprocatively driven along the platen 10. The printing medium 9 is transferred between the impact dot printing head 1 and the platen 10 by the platen 10, a transfer roller (not shown), and so forth. In the case of using a pressure-sensitive coloring paper as the printing medium 9, printing is implemented by coloring of the pressure-sensitive coloring paper due to pressure applied thereto by the respective wires 6. In the case of using an ordinary paper as the printing medium 9, the printing medium 9 is subjected to the pressure of the respective wires 6, through the intermediary of an ink ribbon, and ink of the ink ribbon is transferred to the ordinary paper, thereby implementing printing.

Figure 2:
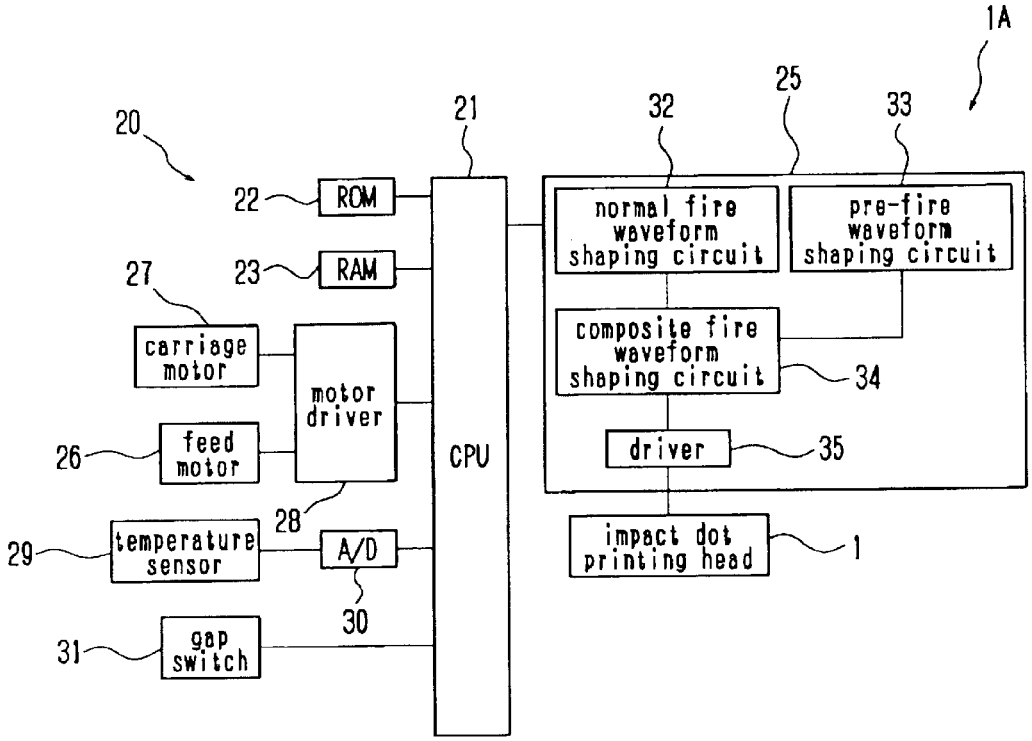
FIG. 2 is a block diagram showing electrical connection of the impact dot printer.

FIG. 2 is a block diagram showing electrical connection of the impact dot printer. The impact dot printer incorporates an impact dot printing head control apparatus 1A for driving the impact dot printing head 1. The impact dot printing head control apparatus 1A has a controller 20. The controller 20 comprises a CPU (Central Processing Unit) 21 for centrally controlling respective components thereof, a ROM (Read Only Memory) 22 for storing respective control programs, and so forth, to be executed by the CPU 21, a RAM (Random Access Memory) 23 functioning as a work area of the CPU 21, and so forth, which are connected with each other via a bus 24.

The impact dot printing head 1 is connected with the CPU 21 via an impact dot printing head drive circuit 25. The impact dot printing head drive circuit 25 is a circuit for driving the impact dot printing head 1.

A feed motor 26 and carriage motor 27 are connected with the CPU 21 via a motor driver 28. The feed motor 26 is a drive source for driving the transfer roller for transferring the printing medium 9 to the printing position, and the carriage motor 27 is a drive source for shifting the carriage with the impact dot printing head 1 mounted thereon in a direction orthogonal to a direction in which paper for printing is transferred. Further, the motor driver 28 is a driver for controlling the driving of the motor.

A temperature sensor 29 is connected with the CPU 21 via an A/D converter 30. The temperature sensor 29 is disposed in the vicinity of the impact dot printing head 1, and is used for detecting temperature in the vicinity of the impact dot printing head 1. The temperature sensor 29 functions as temperature detection means. Furthermore, a gap switch 31 is connected with the CPU 21. The gap switch 31 outputs ON/OFF signals in response to a gap between the impact dot printing head 1 and the platen 10. The gap switch 31 functions as gap detection means.

In accordance with a program stored in the ROM 22, the CPU 21 outputs a drive data signal to the impact dot printing head drive circuit 25 on the basis of printing data and a driving frequency of the impact dot printing head 1.

The impact dot printing head drive circuit 25 comprises a normal fire waveform shaping circuit 32, a pre-fire waveform shaping circuit 33, a composite fire waveform shaping circuit 34, and a driver 35. Further, the normal fire waveform shaping circuit 32 and the pre-fire waveform shaping circuit 33 each have a timer value register (not shown) for storing fire time (energization time). In addition, the pre-fire waveform shaping circuit 33 has a count register (not shown) for storing the number of pre-fire occurrences.

The normal fire waveform shaping circuit 32 generates a normal fire from the drive data signal on the basis of the fire time stored in the timer value register, thereby shaping a normal fire waveform. The normal fire waveform shaping circuit 32 functions as normal fire generation means. As for the normal fire, fire time and firing timing are thereby set. The pre-fire waveform shaping circuit 33 generates a pre-fire in synchronization with the driving frequency, and on the basis of the fire time stored in the timer value register, and the number of the pre-fire occurrences, stored in the count register, thereby shaping a pre-fire waveform. The pre-fire waveform shaping circuit 33 functions as part of pre-fire generation means. As for the pre-fire, fire time and firing timing are thereby set. The composite fire waveform shaping circuit 34 superimposes the pre-fire waveform on the normal fire waveform such that the pre-fire waveform is inserted ahead of the normal fire waveform, thereby shaping a drive fire waveform. The composite fire waveform shaping circuit 34 functions as part of the pre-fire generation means. The driver 35 effects the drive control of the impact dot printing head 1 on the basis of the drive fire waveform. The driver 35 functions as drive control means.

Now, the fire time for the normal fire is set to a value enabling the respective wires 6 of the impact dot printing head 1 to print on the printing medium 9. The fire time for the pre-fire is set to a value disabling the respective wires 6 of the impact dot printing head 1 to print on the printing medium 9. More specifically, the fire time for the normal fire is set to the value at which the respective wires 6 can reach the printing position from the standby position while the fire time for the pre-fire is set to the value at which the respective wires 6 cannot reach the printing position from the standby position. That is, the fire time for the pre-fire is set so as to be shorter than the fire time for the normal fire. This therefore means that the normal fire is a driving fire for causing the respective wires 6 to reach the printing position while the pre-fire is a driving fire for preventing the respective wires 6 from reaching the printing position.

Figure 3:
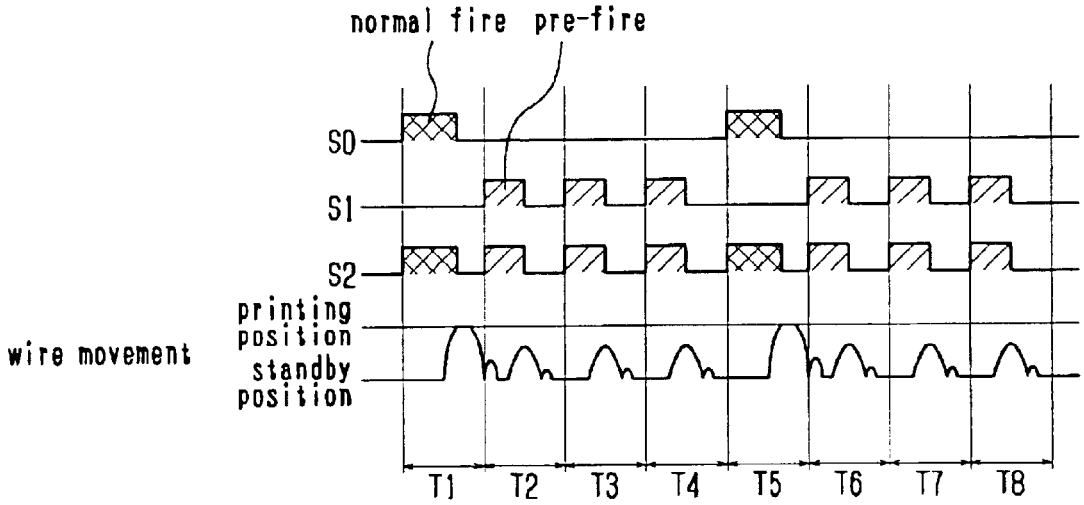
FIG. 3 is a schematic representation illustrating the drive control of an impact dot printing head control apparatus according to a first embodiment of the invention.

FIG. 3 is a schematic representation illustrating the drive control of the impact dot printing head control apparatus according to the first embodiment. Herein, the drive control of one wire 6 among a plurality of the wires 6 will be described (the same applies to other embodiments to be described hereinafter). Also, the number of the pre-fire occurrences, stored in the count register, is ignored herein.

The impact dot printing head drive circuit 25 receives a drive data signal from the CPU 21. The normal fire waveform shaping circuit 32 generates a normal fire on the basis of the drive data signal. A normal fire waveform S0 is thereby shaped. The pre-fire waveform shaping circuit 33 generates a pre-fire on the basis of the driving frequency by using the normal fire as a trigger such that the pre-fire is inserted between normal fires. A pre-fire waveform S1 is thereby shaped. The composite fire waveform shaping circuit 34 superimposes the pre-fire waveform S1 on the normal fire waveform S0. A drive fire waveform S2 is thereby shaped.

Accordingly, the pre-fire waveform shaping circuit 33 and the composite fire waveform shaping circuit 34 generates the pre-fire in every cycle ahead of the normal fire for shaping the normal fire waveform S0. Thus, the functions of the pre-fire generation means are implemented.

Based on the drive fire waveform S2, the driver 35 causes current to flow to the coil 4 of the impact dot printing head 1, thereby effecting the drive control of the wire 6 of the impact dot printing head 1. The drive control of the impact dot printing head 1 is effected in this way by the impact dot printing head drive circuit 25.

Thus, by the pre-fire, the wire 6 of the impact dot printing head 1 is always in a state of working within a range disabling printing on the printing medium 9. Accordingly, even at the time of low temperature when the wire 6 has difficulty in movement, the wire 6 is always in the state of working, so that the performance of the impact dot printing head 1 can be ensured without the need of rendering energy applied to the impact dot printing head 1 variable as with the case of the conventional art. Furthermore, since there is no need of providing a large power source in order to drive the wire 6 at the time of low temperature, and the specification of driver components for the impact dot printing head 1 can be downsized, it is possible to implement reduction in product cost and miniaturization of a product. Still further, since execution of such control as to generate a pre-fire between normal fires all the time will suffice for the purpose of operation, a simple control can be realized.

There has thus far been described a case where the pre-fire is generated ahead of the normal fire in every cycle, however, the invention is not limited to such a case. For example, the pre-fire may be generated once immediately before the normal fire, or the pre-fire may be generated plural times immediately before the normal fire.

Figure 4:
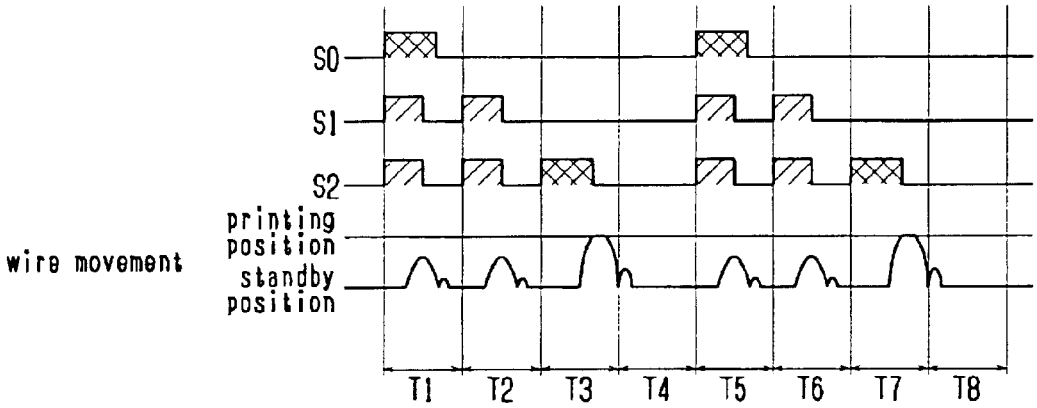
FIG. 4 is a schematic representation illustrating the drive control of an impact dot printing head control apparatus according to variation 1 of the first embodiment.

Variation 1 of the first embodiment of the invention is described hereinafter with reference to FIG. 4. In the figure, parts corresponding to those for the first embodiment are denoted by like reference numerals, omitting description thereof. FIG. 4 is a schematic representation illustrating the drive control of an impact dot printing head control apparatus according to the variation 1 of the first embodiment.

An impact dot printing head drive circuit 25 receives a drive data signal from a CPU 21. A normal fire waveform shaping circuit 32 generates a normal fire on the basis of the drive data signal. A normal fire waveform S0 is thereby shaped. A pre-fire waveform shaping circuit 33 generates two pre-fires on the basis of a driving frequency by using the normal fire as a trigger. A pre-fire waveform S1 is thereby shaped. At this point in time, the number of pre-fire occurrences, stored in a count register, is set to two. A composite fire waveform shaping circuit 34 delays the normal fire by two cycles, and superimposes the pre-fire waveform S1 on the normal fire waveform S0. A drive fire waveform S2 is thereby shaped.

Accordingly, the pre-fire waveform shaping circuit 33 and the composite fire waveform shaping circuit 34 generate pre-fires in a period from a cycle ahead of the normal fire by two cycles to a cycle immediately before the normal fire. Thus, the functions of pre-fire generation means are implemented. Although there has been described hereinabove a case where the pre-fires are generated in the period from the cycle ahead of the normal fire by two cycles to the cycle immediately before the normal fire, however, the invention is not limited to such a case. For example, the pre-fires maybe generated in a period from a cycle ahead of the normal fire by four cycles to the cycle immediately before the normal fire. Further, the composite fire waveform shaping circuit 34 may superimpose the pre-fire waveform S1 on the normal fire waveform S0 such that the normal fire is preferentially left (the same applies to the other embodiments as well).

Based on the drive fire waveform S2, a driver 35 causes current to flow to a coil 4 of the impact dot printing head 1, thereby effecting the drive control of a wire 6 of the impact dot printing head 1. The drive control of the impact dot printing head 1 is effected in this way by the impact dot printing head drive circuit 25.

Thus, by the pre-fire, the wire 6 of the impact dot printing head 1 is in a state of working within a range disabling printing on the printing medium 9 before printing operation by the normal fire. For example, in FIG. 4, the wire 6 is in the state of working twice within the range disabling printing on the printing medium 9 before the printing operation by the normal fire. Accordingly, even at the time of low temperature when the wire 6 has difficulty in movement, the wire 6 remains in the state of working before the printing operation is actually executed, so that the variation 1 can gain an advantageous effect similar to that for the first embodiment. Further, in case the impact dot printer is out of the printing operation for a while, the wire 6 is not in the state of working, so that excessive consumption of energy can be prevented.

Figure 5:
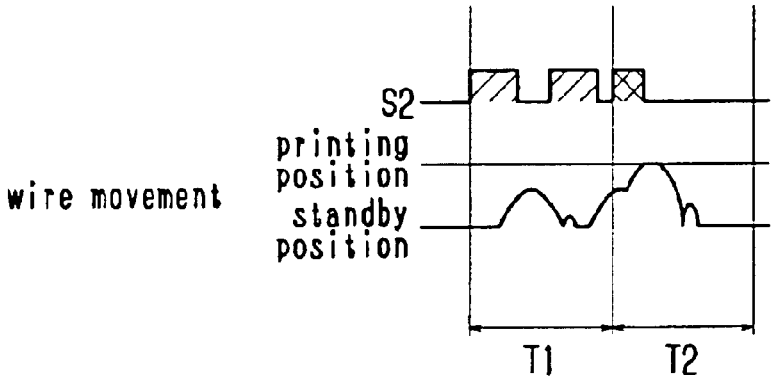
FIG. 5 is a schematic representation illustrating the drive control of an impact dot printing head control apparatus according to variation 2 of the first embodiment.

Variation 2 of the first embodiment of the invention is described hereinafter with reference to FIG. 5. In the figure, parts corresponding to those for the first embodiment are denoted by like reference numerals, omitting description thereof. FIG. 5 is a schematic representation illustrating the drive control of an impact dot printing head control apparatus according to the variation 2 of the first embodiment.

An impact dot printing head drive circuit 25 receives a drive data signal from a CPU 21. A normal fire waveform shaping circuit 32 generates a normal fire on the basis of the drive data signal. A normal fire waveform S0 is thereby shaped. A pre-fire waveform shaping circuit 33 generates two pre-fires in one cycle on the basis of a driving frequency by using the normal fire as a trigger. A pre-fire waveform S1 is thereby shaped. At this point in time, the number of pre-fire occurrences, stored in a count register, is set to two. A composite fire waveform shaping circuit 34 delays the normal fire by one cycle, and superimposes the pre-fire waveform S1 on the normal fire waveform S0. A drive fire waveform S2 is thereby shaped.

Accordingly, the pre-fire waveform shaping circuit 33 and the composite fire waveform shaping circuit 34 generate the two pre-fires in a cycle immediately before the normal fire. Thus, the functions of pre-fire generation means are implemented. Although there has been described hereinabove a case where the two pre-fires are generated in the cycle immediately before the normal fire, however, the invention is not limited to such a case. For example, four pre-fires maybe generated in the cycle immediately before the normal fire.

Based on the drive fire waveform S2, a driver 35 causes current to flow to a coil 4 of the impact dot printing head 1, thereby effecting the drive control of a wire 6 of the impact dot printing head 1. The drive control of the impact dot printing head 1 is effected in this way by the impact dot printing head drive circuit 25.

Thus, by the pre-fire, the wire 6 of the impact dot printing head 1 is in a state of working within a range disabling printing on the printing medium 9 before printing operation by the normal fire. For example, in FIG. 5, the wire 6 is in the state of working twice within the range disabling printing on the printing medium 9 before the printing operation by the normal fire. Accordingly, even at the time of low temperature when the wire 6 has difficulty in movement, the wire 6 remains in the state of working before the printing operation is actually executed, so that the variation 2 can gain an advantageous effect similar to that for the first embodiment. Further, when the impact dot printer is out of the printing operation for a while, the wire 6 is not in the state of working, so that excessive consumption of energy can be prevented. Furthermore, because fire time of the normal fire can be shortened, it becomes possible to prevent excessive consumption of energy more than in the cases of the first embodiment and the variation 1.

Figure 6:
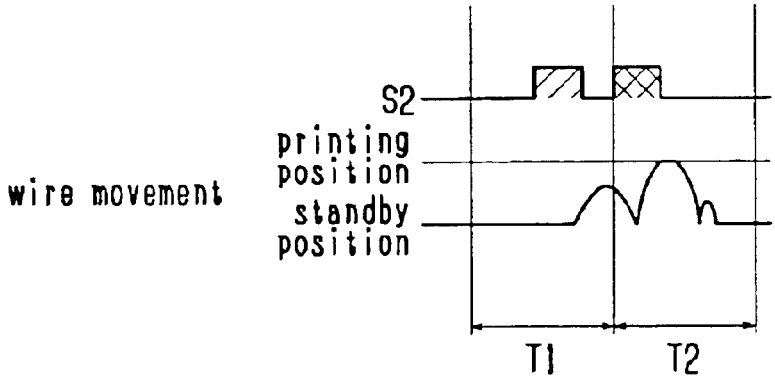
FIG. 6 is a schematic representation illustrating the drive control of an impact dot printing head control apparatus according to a second embodiment of the invention.

A second embodiment of the invention is described hereinafter with reference to FIG. 6. In the figure, parts corresponding to those for the first embodiment are denoted by like reference numerals, omitting description thereof. FIG. 6 is a schematic representation illustrating the drive control of an impact dot printing head control apparatus according to the second embodiment of the invention.

A wire 6 of a impact dot printing head 1 is caused to move in a printing direction (direction towards a printing medium 9) from a standby position by a pre-fire. However, because fire time of the pre-fire is shorter than fire time of a normal fire, the wire 6 does not abut against the printing medium 9. Accordingly, the printing medium 9 is not printed on. Thereafter, the wire 6 returns to the original standby position by the urging of urging members, whereupon an armature 3 is butted against a stopper 7, and is caused to rock a little in the printing direction by repulsive force of the stopper 7. Consequently, the wire 6 as well moves a little in the printing direction. That is, the wire 6 returns to the standby position after moving in the printing direction, whereupon the wire 6 moves again in the printing direction after rebounding.

An impact dot printing head drive circuit 25 receives a drive data signal from a CPU 21. A normal fire waveform shaping circuit 32 generates a normal fire on the basis of the drive data signal. A normal fire waveform S0 is thereby shaped. A pre-fire waveform shaping circuit 33 generates one pre-fire by using the normal fire as a trigger. A pre-fire waveform S1 is thereby shaped. At this point in time, the number of pre-fire occurrences, stored in a count register, is set to one. A composite fire waveform shaping circuit 34 delays the normal fire by one cycle, and superimposes the pre-fire waveform S1 on the normal fire waveform S0. A drive fire waveform S2 is thereby shaped.

At this point in time, the pre-fire waveform shaping circuit 33 and the composite fire waveform shaping circuit 34 generate the pre-fire before the normal fire at a timing in which the normal fire is generated while the wire 6 returning to the standby position after driven by the pre-fire is moving again in the printing direction due to rebounding. The drive fire waveform S2 is thereby shaped. Thus, the functions of pre-fire generation means are implemented. More specifically, timing of the pre-fire, in relation to the normal fire, is adjusted. For example, an interval between the fall time of the pre-fire and the rise time of the normal fire is adjusted.

Based on the drive fire waveform S2, a driver 35 causes current to flow to a coil 4 of the impact dot printing head 1, thereby effecting the drive control of the wire 6 of the impact dot printing head 1. The drive control of the impact dot printing head 1 is effected in this way by the impact dot printing head drive circuit 25.

Thus, by the pre-fire, the wire 6 of the impact dot printing head 1 is in a state of working within a range disabling printing on the printing medium 9 before printing operation by the normal fire. Thereafter, the wire 6 returns to the original standby position by the urging of the urging members, whereupon the wire 6 rebounds and is caused to move again in the printing direction. Transfer force in the printing direction, applied to the wire 6 by the pre-fire at this point in time, can support movement of the wire 6, in the printing direction by the normal fire. Consequently, printing operation of the wire 6 by the normal fire can be more stabilized as compared with the cases of the first embodiment and the variation 1 thereof. As a result, stable performance of the impact dot printing head 1 can be obtained. Further, since fire time of the normal fire can be shortened, it becomes possible to cut down on consumption of energy.

Figure 7:
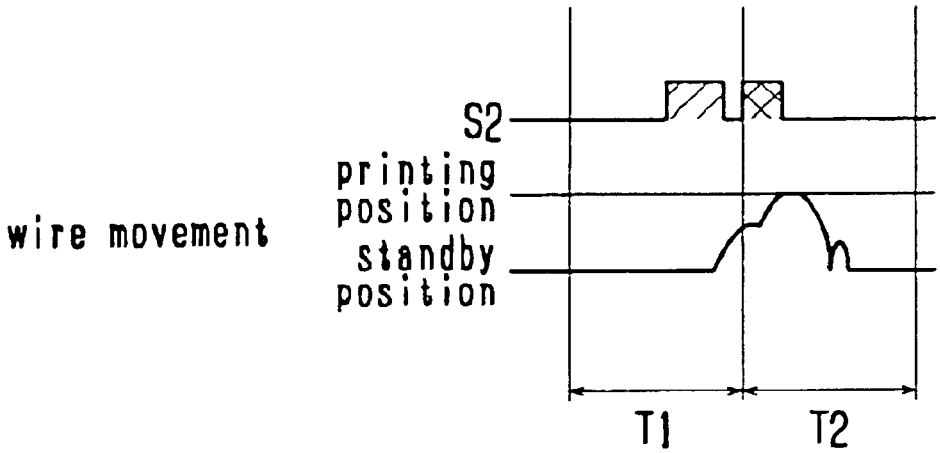
FIG. 7 is a schematic representation illustrating the drive control of an impact dot printing head control apparatus according to variation 1 of the second embodiment.

A variationof the second embodiment of the invention is described herein after with reference to FIG. 7. In the figure, parts corresponding to those for the second embodiment are denoted by like reference numerals, omitting description thereof. FIG. 7 is a schematic representation illustrating the drive control of an impact dot printing head control apparatus according to the variation 1 of the second embodiment of the invention.

As with the second embodiment, a drive fire waveform S2 is shaped by an impact dot printing head drive circuit 25. At this point in time, a pre-fire waveform shaping circuit 33 and a composite fire waveform shaping circuit 34 generate a pre-fire immediately before a normal fire at a timing in which the normal fire is generated while a wire 6 is moving in a printing direction by the pre-fire. The drive fire waveform S2 is thereby shaped. More specifically, a timing of the pre-fire, in relation to the normal fire, is adjusted. For example, an interval between the fall time of the pre-fire and the rise time of the normal fire is adjusted.

Based on the drive fire waveform S2, a driver 35 causes current to flow to a coil 4 of an impact dot printing head 1, thereby effecting the drive control of the wire 6 of the impact dot printing head 1. The drive control of the impact dot printing head 1 is effected in this way by the impact dot printing head drive circuit 25.

Thus,by the pre-fire, the wire 6 of the impact dot printing head 1 is caused to move in the printing direction before printing operation by the normal fire. Transfer force in the printing direction, applied to the wire 6 by the pre-fire at this point in time, can support movement of the wire 6 in the printing direction by the normal fire. Consequently, an advantageous effect similar to that of the second embodiment can be obtained, and in addition, fire time of the normal fire can be shortened as compared with the case of the second embodiment, so that it becomes possible to cut down further on consumption of energy.

Figure 8:
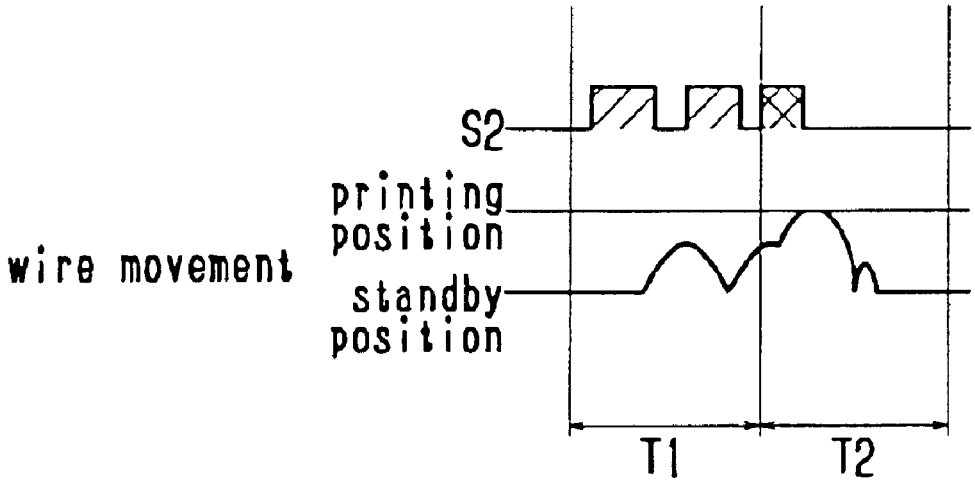
FIG. 8 is a schematic representation illustrating the drive control of an impact dot printing head control apparatus according to variation 2 of the second embodiment.

A variation 2 of the second embodiment of the invention is described herein after with reference to FIG. 8. In the figure, parts corresponding to those for the second embodiment are denoted by like reference numerals, omitting description thereof. FIG. 8 is a schematic representation illustrating the drive control of an impact dot printing head control apparatus according to the variation 2 of the second embodiment of the invention.

As with the second embodiment, a drive fire waveform S2 is shaped by an impact dot printing head drive circuit 25. At this time, a pre-fire waveform shaping circuit 33 and a composite fire waveform shaping circuit 34 generate pre-fires immediately before a normal fire such that transfer force in the printing direction, applied to a wire 6, can support movement of the wire 6 by the normal fire. The drive fire waveform S2 is thereby shaped. More specifically, respective timings of two pre-fires, in relation to the normal fire, are adjusted. For example, an interval between the fall time of a first pre-fire and the rise time of a second pre-fire is adjusted such that the first pre-fire is generated at a timing in which the second pre-fire is generated while the wire 6 returning to a standby position after driven by the first pre-fire is moving in the printing direction due to rebounding. Further, an interval between the fall time of the second pre-fire and the rise time of the normal fire is adjusted such that the second pre-fire is generated at a timing in which the normal fire is generated while the wire 6 returning to the standby position after driven by the second pre-fire is moving in the printing direction due to rebounding.

Based on the drive fire waveform S2, a driver 35 causes current to flow to a coil 4 of an impact dot printing head 1, thereby effecting the drive control of the wire 6 of the impact dot printing head 1. The drive control of the impact dot printing head 1 is effected in this way by the impact dot printing head drive circuit 25.

Thus, by the first pre-fire, the wire 6 of the impact dot printing head 1 is in a state of working within a range disabling printing on the printing medium 9 before printing operation by the normal fire. Thereafter, the wire 6 returns to the original standby position by the urging of the urging members, whereupon the wire 6 rebounds and is caused to move again in the printing direction. Transfer force in the printing direction, applied to the wire 6 by the first pre-fire at this point in time, can support movement of the wire 6, in the printing direction, by the normal fire. Subsequently, the wire 6 is caused to move in the printing direction by the second pre-fire before the printing operation by the normal fire. Transfer force in the printing direction, applied to the wire 6 by the second pre-fire at this point in time, can support movement of the wire 6, in the printing direction, by the normal fire. Consequently, an advantageous effect similar to that of the second embodiment can be obtained, and in addition, fire time of the normal fire can be shortened as compared with the case of the second embodiment, so that it becomes possible to cut down further on consumption of energy.

Figure 9:
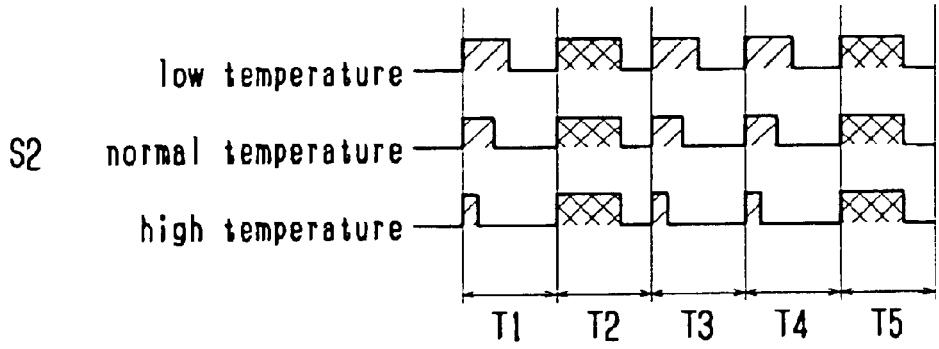
FIG. 9 is a schematic representation illustrating the drive control of an impact dot printing head control apparatus according to a third embodiment of the invention.

A third embodiment of the invention is described hereinafter with reference to FIG. 9. In the figure, parts corresponding to those for the first embodiment are denoted by like reference numerals, omitting description thereof. FIG. 9 is a schematic representation illustrating the drive control of an impact dot printing head control apparatus according to the third embodiment of the invention.

Based on a program stored in a ROM 22, temperature detected by a temperature sensor 29 is differentiated by a CPU 21 among three categories, low temperature/normal temperature/high temperature. In this case, the temperature is differentiated among the three categories, however, the scope of the invention is not limited thereto, and the temperature may be differentiated, for example, between only two categories or among four categories.

The CPU 21 renders fire time of a pre-fire variable on the basis of the temperature. For example, if the temperature is the low temperature, the CPU 21 sets a timer value, higher than a timer value at the time of the normal temperature, in a timer value register of a pre-fire waveform shaping circuit 33. Based on the set timer value, the pre-fire waveform shaping circuit 33 shapes a pre-fire waveform S1. A drive fire waveform S2 at the time of the low temperature is thereby shaped as shown in FIG. 9. If the temperature is high, the CPU 21 sets a timer value lower than that at the time of the normal temperature in the timer value register of the pre-fire waveform shaping circuit 33. Based on the set timer value, the pre-fire waveform shaping circuit 33 shapes a pre-fire waveform S1. A drive fire waveform S2 at the time of the high temperature is thereby shaped as shown in FIG. 9. Accordingly, the CPU 21 controls the fire time such that the higher the temperature detected by the temperature sensor 29 is, the shorter the fire time of the pre-fire is rendered. Thus, the functions of fire time control means are implemented.

In this way, the fire time of the pre-fire is rendered variable depending on temperature. Accordingly, an advantageous effect similar to that of the first embodiment can be obtained, and in addition, since the fire time of the pre-fire can be varied depending on change in temperature, excessive consumption of energy can be prevented. Also, it becomes possible to stabilize the performance of an impact dot printing head 1 by coping with variation in temperature.

With the third embodiment, the CPU 21 renders the fire time of the pre-fire variable based on temperature, however, the scope of the invention is not limited thereto. For example, the CPU 21 may render the number of pre-fire occurrences variable based on temperature, and, further, may render the number of pre-fire occurrences in one cycle variable based on temperature.

Figure 10:
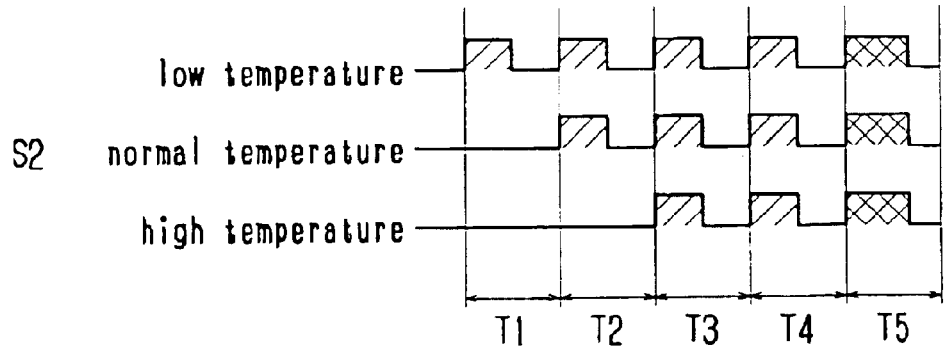
FIG. 10 is a schematic representation illustrating the control of the number of pre-fire occurrences on the basis of temperature.

Now, there is described a case of the CPU 21 rendering the number of pre-fire occurrences variable on the basis of temperature with reference to FIG. 10. FIG. 10 is a schematic representation illustrating the control of the number of pre-fire occurrences on the basis of temperature.

Figure 11:
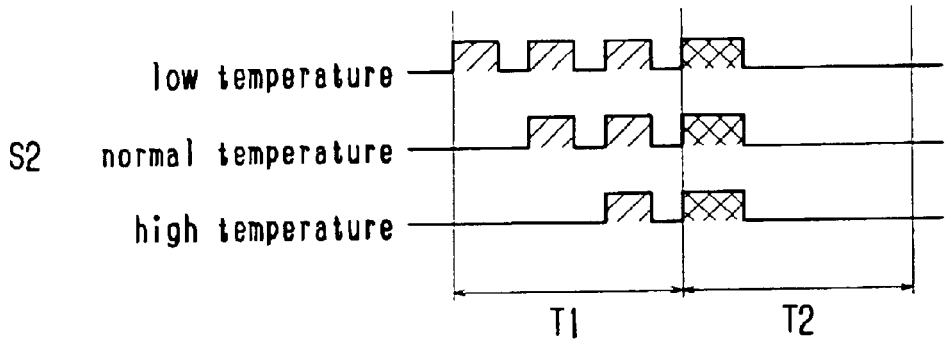
FIG. 11 is a schematic representation illustrating the control of the number of pre-fire occurrences in one cycle on the basis of temperature.

The CPU 21 renders variable the number of pre-fire occurrences based on temperature. For example, if temperature is low, the CPU 21 sets the number of pre-fire occurrences so as to be more than that at the time of the normal temperature, in a count register of the pre-fire waveform shaping circuit 33. For example, the CPU 21 sets the number of the pre-fire occurrences to four. As a result, the drive fire waveform S2 at the time of the low temperature is shaped as shown in FIG. 10. If temperature is the high temperature, the CPU 21 sets the number of pre-fire occurrences so as to be less than that at the time of the normal temperature, in the count register of the pre-fire waveform shaping circuit 33. For example, the CPU 21 sets the number of the pre-fire occurrences to two. As a result, the drive fire waveform S2 at the time of the high temperature is shaped as shown in FIG. 10. Accordingly, the CPU 21 controls the number of pre-fire occurrences such that the higher the temperature detected by the temperature sensor 29 is, the less the number of pre-fire occurrences becomes. Thus, the functions of occurrence count control means are implemented. In this way, the number of pre-fire occurrences is rendered variable depending on temperature. Accordingly, an advantageous effect similar to that of the first embodiment can be obtained, Next, there is described a case of the CPU 21 rendering variable the number of pre-fire occurrences in one cycle on the basis of temperature with reference to FIG. 11. FIG. 11 is a schematic representation illustrating the control of the number of pre-fire occurrences in one cycle on the basis of temperature.

The CPU 21 renders variable the number of pre-fire occurrences in one cycle based on temperature. For example, if temperature is low, the CPU 21 sets the number of pre-fire occurrences in one cycle so as to be more than that at the time of the normal temperature in the count register of the pre-fire waveform shaping circuit 33. For example, the CPU 21 sets the number of the pre-fire occurrences in one cycle to three. As a result, the drive fire waveform S2 at the time of the low temperature is shaped as shown in FIG. 11. If temperature is the high temperature, the CPU 21 sets the number of pre-fire occurrences in one cycle so as to be less than that at the time of the normal temperature in the count register of the pre-fire waveform shaping circuit 33. For example, the CPU 21 sets the number of the pre-fire occurrences in one cycle to one. As a result, the drive fire waveform S2 at the time of the high temperature is shaped as shown in FIG. 11. Accordingly, the CPU 21 controls the number of pre-fire occurrences in one cycle such that the higher the temperature detected by the temperature sensor 29 is, the less the number of pre-fire occurrences in one cycle is rendered. Thus, the functions of occurrence count control means are implemented. In this way, the number of pre-fire occurrences in one cycle is rendered variable depending on temperature. Accordingly, an advantageous effect similar to that of the third embodiment can be obtained.

Figure 12:
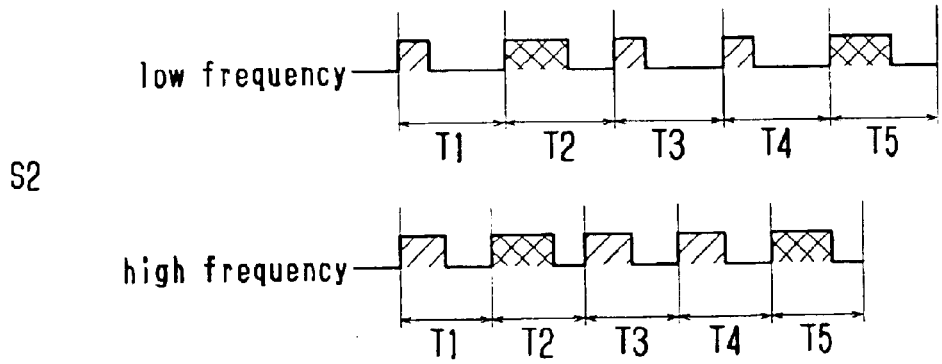
FIG. 12 is a schematic representation illustrating the drive control of an impact dot printing head control apparatus according to a fourth embodiment of the invention.

A fourth embodiment of the invention is described hereinafter with reference to FIG. 12. In the figure, parts corresponding to those for the first embodiment are denoted by like reference numerals, omitting description thereof. FIG. 12 is a schematic representation illustrating the drive control of an impact dot printing head control apparatus according to the fourth embodiment of the invention.

Based on a program stored in a ROM 22, a CPU 21 renders a driving frequency of an impact dot printing head 1 variable depending on printing conditions, for example, a printing duty, and differentiates the driving frequency between two categories, that is, a low frequency and a high frequency. The functions of driving frequency variable means are thereby implemented. Further, with the fourth embodiment, the driving frequency is differentiated between the two categories, the low frequency and the high frequency, however, the scope of the invention is not limited thereto. For example, the driving frequency may be differentiated among three categories.

The CPU 21 renders fire time of a pre-fire variable on the basis of the driving frequency. For example, if the driving frequency is the low frequency, the CPU 21 sets a timer value, lower than a timer value for a case where the driving frequency is the high frequency, in a timer value register of a pre-fire waveform shaping circuit 33. Based on the set timer value, the pre-fire waveform shaping circuit 33 shapes a pre-fire waveform S1. A drive fire waveform S2 at the time of the low frequency is thereby shaped as shown in FIG. 12. If the driving frequency is the high frequency, the CPU 21 sets a timer value, higher than the timer value for a case where the driving value is the low frequency, in the timer value register of the pre-fire waveform shaping circuit 33. Based on the set timer value, the pre-fire waveform shaping circuit 33 shapes a pre-fire waveform S1. A drive fire waveform S2 at the time of the high frequency is thereby shaped as shown in FIG. 12. Accordingly, the CPU 21 controls fire time such that the lower the driving frequency as varied is, the shorter the fire time of the pre-fire is rendered. Thus, the functions of fire time control means are implemented.

In this way, the fire time of the pre-fire is rendered variable on the basis of the driving frequency. Accordingly, an advantageous effect similar to that of the first embodiment can be obtained, and in addition, since the fire time of the pre-fire can be varied corresponding to variation in the driving frequency, excessive consumption of energy can be prevented. Further, it is possible to stabilize the performance of an impact dot printing head 1 by coping with variation in the driving frequency.

With the fourth embodiment, the CPU 21 renders the fire time of the pre-fire variable based on the driving frequency, however, the scope of the invention is not limited thereto. For example, the CPU 21 may render the number of pre-fire occurrences variable based on the driving frequency, and, further, may render the number of pre-fire occurrences in one cycle variable based on the driving frequency.

Figure 13:
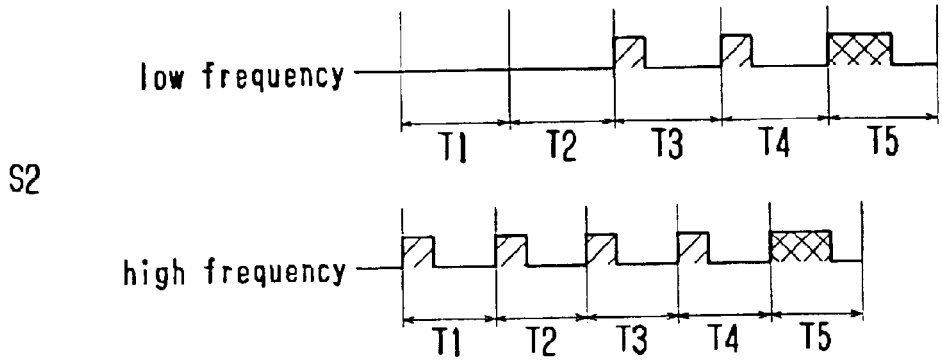
FIG. 13 is a schematic representation illustrating the control of the number of pre-fire occurrences on the basis of a driving frequency.

Now, there is described a case of the CPU 21 rendering the number of pre-fire occurrences variable based on the driving frequency with reference to FIG. 13. FIG. 13 is a schematic representation illustrating the control of the number of pre-fire occurrences based on the driving frequency.

The CPU 21 renders the number of pre-fire occurrences variable based on the driving frequency. For example, if the driving frequency is the low frequency, the CPU 21 sets the number of pre-fire occurrences so as to be less than the number of pre-fire occurrences in the case where the driving frequency is the high frequency in the count register of the pre-fire waveform shaping circuit 33. For example, the CPU 21 sets the number of the pre-fire occurrences to two. As a result, a drive fire waveform S2 at the time of the low frequency is shaped as shown in FIG. 13. If the driving frequency is the high frequency, the CPU 21 sets the number of pre-fire occurrences so as to be more than the number of pre-fire occurrences in the case where the driving frequency is the low frequency in the count register of the pre-fire waveform shaping circuit 33. For example, the CPU 21 sets the number of the pre-fire occurrences to four. As a result, a drive fire waveform S2 at the time of the high frequency is shaped as shown in FIG. 13. Accordingly, the CPU 21 controls the number of pre-fire occurrences such that the lower the driving frequency as varied is, the less the number of pre-fire occurrences becomes. Thus, the functions of occurrence count control means are implemented. In this way, the number of pre-fire occurrences is rendered variable on the basis of the driving frequency. Accordingly, an advantageous effect similar to that of the fourth embodiment can be obtained.

Figure 14:
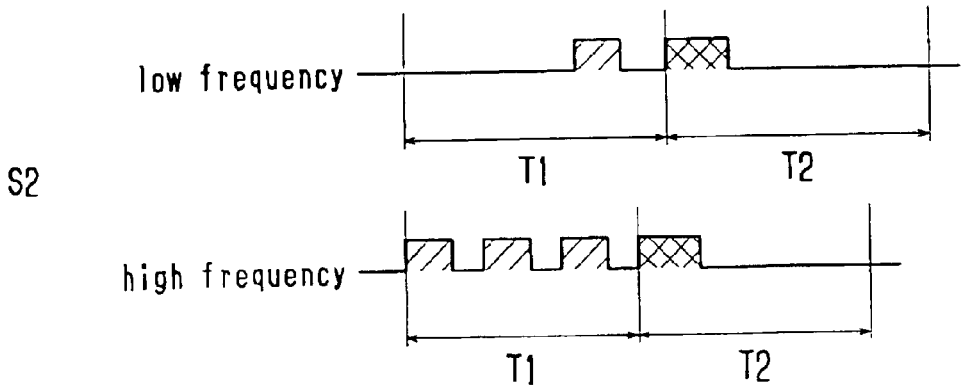
FIG. 14 is a schematic representation illustrating the control of the number of pre-fire occurrences in one cycle on the basis of the driving frequency.

Next, there is described a case of the CPU 21 rendering the number of pre-fire occurrences in one cycle variable based on the driving frequency with reference to FIG. 14. FIG. 14 is a schematic representation illustrating the control of the number of pre-fire occurrences in one cycle based on the driving frequency.

The CPU 21 renders variable the number of pre-fire occurrences in one cycle based on the driving frequency. For example, if the driving frequency is the low frequency, the CPU 21 sets the number of pre-fire occurrences in one cycle so as to be less than the number of pre-fire occurrences in one cycle in the case where the driving frequency is the high frequency in the count register of the pre-fire waveform shaping circuit 33. For example, the CPU 21 sets the number of the pre-fire occurrences in one cycle to one. As a result, a drive fire waveform S2 at the time of the low frequency is shaped as shown in FIG. 14. If the driving frequency is the high frequency, the CPU 21 sets the number of pre-fire occurrences in one cycle so as to be more than the number of pre-fire occurrences in one cycle where the driving frequency is the low frequency in the count register of the pre-fire waveform shaping circuit 33. For example, the CPU 21 sets the number of the pre-fire occurrences in one cycle to three. As a result, a drive fire waveform S2 at the time of the high frequency is shaped as shown in FIG. 14. Accordingly, the CPU 21 controls the number of pre-fire occurrences such that the lower the driving frequency as varied is, the less the number of pre-fire occurrences becomes. Thus, the functions of the occurrence count control means are implemented. In this way, the number of pre-fire occurrences in one cycle is rendered variable on the basis of the driving frequency. Accordingly, an advantageous effect similar to that of the fourth embodiment can be obtained.

Figure 15:
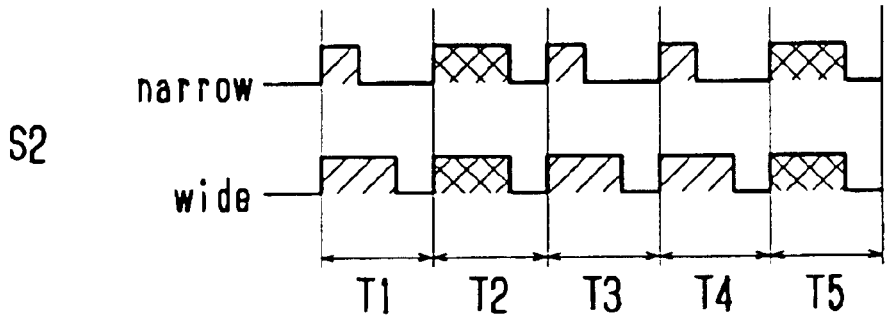
FIG. 15 is a schematic representation illustrating the drive control of an impact dot printing head control apparatus according to a fifth embodiment of the invention.

A fifth embodiment of the invention is described hereinafter with reference to FIG. 15. In the figure, parts corresponding to those for the first embodiment are denoted by like reference numerals, omitting description thereof. FIG. 15 is a schematic representation illustrating the drive control of an impact dot printing head control apparatus according to the fifth embodiment of the invention.

Based on a program stored in a ROM 22, a CPU 21 determines the extent of a gap in response to the result of detection by a gap switch 31, that is, ON/OFF thereof. More specifically, the CPU 21 determines that the gap is wide if the gap switch 31 is ON, and determines that the gap is narrow if the gap switch 31 is OFF. In this case, the gap is differentiated between two categories (wide/narrow), however, the scope of the invention is not limited thereto. For example, the gap may be differentiated among three categories. Further, in this case, the gap switch 31 is used as detection means for detecting the gap, however, the scope of the invention is not limited thereto.

Based on the result of gap detection, the CPU 21 renders fire time of a pre-fire variable. For example, if the gap is narrow, the CPU 21 sets a timer value lower than that for a case where the gap is wide in a timer value register of a pre-fire waveform shaping circuit 33. Based on the set timer value, the pre-fire waveform shaping circuit 33 shapes a pre-fire waveform S1. A drive fire waveform S2 at the time when the gap is narrow is thereby shaped as shown in FIG. 15. If the gap is wide, the CPU 21 sets a timer value higher than that where the gap is narrow in the timer value register of the pre-fire waveform shaping circuit 33. Based on the set timer value, the pre-fire waveform shaping circuit 33 shapes a pre-fire waveform S1. A drive fire waveform S2 at the time when the gap is wide is thereby shaped as shown in FIG. 15. Accordingly, the CPU 21 controls fire time such that the narrower the gap is, the shorter the fire time of the pre-fire is rendered. Thus, the functions of fire time control means are implemented.

In this way, the fire time of the pre-fire is rendered variable on the basis of the result of the gap detection. Accordingly, an advantageous effect similar to that of the first embodiment can be obtained, and in addition, since the fire time of the pre-fire can be rendered variable on the basis of the result of the gap detection, excessive consumption of energy can be prevented. Further, it is possible to stabilize the performance of the impact dot printing head 1 by coping with variation in the gap.

With the fifth embodiment, the CPU 21 renders the fire time of the pre-fire variable based on the result of the gap detection, however, the scope of the invention is not limited thereto. For example, the CPU 21 may render the number of pre-fire occurrences variable based on the result of the gap detection, and, further, may render the number of pre-fire occurrences in one cycle variable based on the result of the gap detection.

Figure 16:
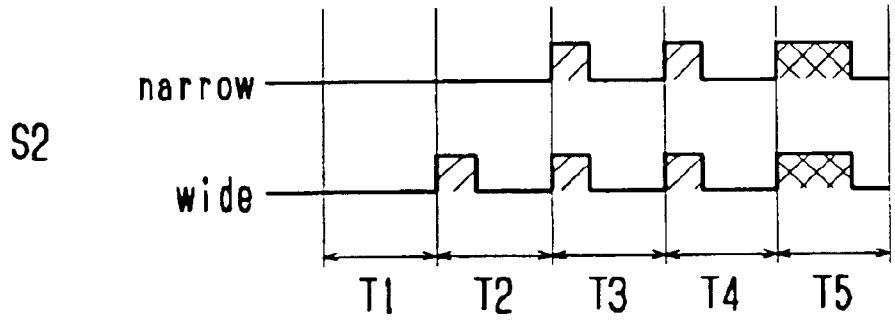
FIG. 16 is a schematic representation illustrating the control of the number of pre-fire occurrences on the basis of the result of gap detection.

Now, there is described a case of the CPU 21 rendering the number of pre-fire occurrences variable based on the result of the gap detection with reference to FIG. 16. FIG. 16 is a schematic representation illustrating the control of the number of pre-fire occurrences based on the result of the gap detection.

The CPU 21 renders the number of pre-fire occurrences variable based on the result of the gap detection. For example, if the gap is narrow, the CPU 21 sets the number of pre-fire occurrences so as to be less than the number of pre-fire occurrences in the case where the gap is wide in a count register of the pre-fire waveform shaping circuit 33. For example, the CPU 21 sets the number of the pre-fire occurrences to two. As a result, a drive fire waveform S2 at the time when the gap is narrow is shaped as shown in FIG. 16. If the gap is wide, the CPU 21 sets the number of pre-fire occurrences so as to be more than the number of pre-fire occurrences in the case where the gap is narrow in the count register of the pre-fire waveform shaping circuit 33. For example, the CPU 21 sets the number of the pre-fire occurrences to three. As a result, a drive fire waveform S2 at the time when the gap is wide is shaped as shown in FIG. 16. Accordingly, the CPU 21 controls the number of pre-fire occurrences such that the narrower the gap is, the less the number of pre-fire occurrences becomes. Thus, the functions of the occurrence count control means are implemented. In this way, the number of pre-fire occurrences is rendered variable on the basis of the result of the gap detection. In this way, the number of pre-fire occurrences is rendered variable on the basis of-the result of the gap detection. Accordingly, an advantageous effect similar to that of the fifth embodiment can be obtained.

Figure 17:
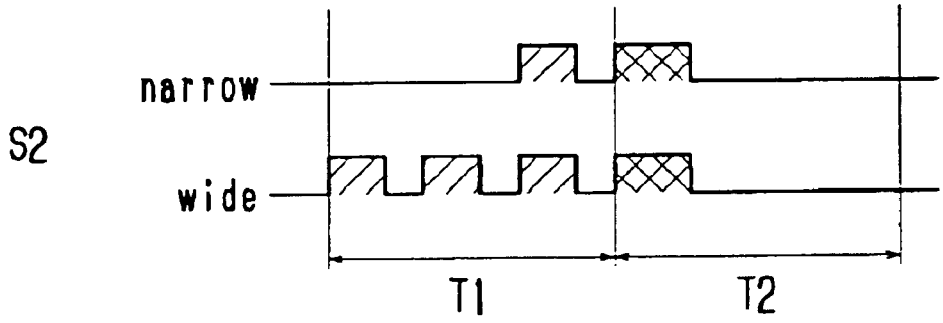
FIG. 17 is a schematic representation illustrating the control of the number of pre-fire occurrences in one cycle on the basis of the result of the gap detection.

Next, there is described a case of the CPU 21 rendering the number of pre-fire occurrences in one cycle variable based on the result of the gap detection with reference to FIG. 17. FIG. 17 is a schematic representation illustrating the control of the number of pre-fire occurrences in one cycle based on the result of the gap detection.

The CPU 21 renders the number of pre-fire occurrences in one cycle variable based on the result of the gap detection. For example, if the gap is narrow, the CPU 21 sets the number of pre-fire occurrences in one cycle so as to be less than the number of pre-fire occurrences in one cycle in the case where the gap is wide in the count register of the pre-fire waveform shaping circuit 33. For example, the CPU 21 sets the number of pre-fire occurrences to one. As a result, a drive fire waveform S2 at the time when the gap is narrow is shaped as shown in FIG. 17. If the gap is wide, the CPU 21 sets the number of pre-fire occurrences in one cycle so as to be more than the number of pre-fire occurrences in one cycle in the case where the gap is narrow in the count register of the pre-fire waveform shaping circuit 33. For example, the CPU 21 sets the number of pre-fire occurrences in one cycle to three. As a result, a drive fire waveform S2 at the time when the gap is wide is shaped as shown in FIG. 17. Accordingly, the CPU 21 controls the number of pre-fire occurrences such that the narrower the gap, the less the number of pre-fire occurrences in one cycle becomes. Thus, the functions of the occurrence count control means are implemented. In this way, the number of pre-fire occurrences in one cycle is rendered variable on the basis of the result of the gap detection. Accordingly, an advantageous effect similar to that of the fifth embodiment can be obtained.

Figure 18:
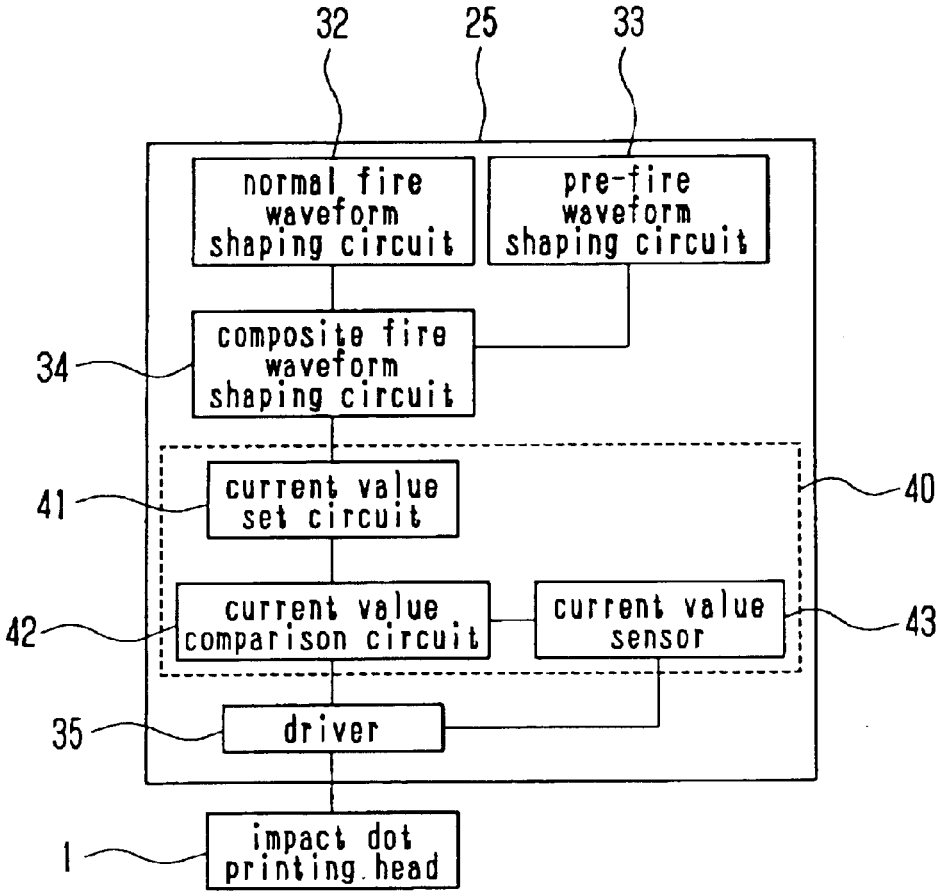
FIG. 18 is a block diagram showing a drive circuit of an impact dot printing head control apparatus according to a sixth embodiment of the invention.

A sixth embodiment of the invention is described hereinafter with reference to FIG. 18. In the figure, parts corresponding to those for the first embodiment are denoted by like reference numerals, omitting description thereof. FIG. 18 is a block diagram showing a drive circuit of an impact dot printing head control apparatus according to the sixth embodiment of the invention.

Based on a program stored in a ROM 22, temperature detected by a temperature sensor 29 is differentiated by a CPU 21 among three categories, low temperature/normal temperature/high temperature. In this case, the temperature is differentiated among the three categories, however, the scope of the invention is not limited thereto, and the temperature may be differentiated, for example, between only two categories or among four categories.

As shown in FIG. 18, an impact dot printing head drive circuit 25 comprises a variable current circuit 40. The variable current circuit 40 is installed between a composite fire waveform shaping circuit 34 and a driver 35 to be connected therewith, respectively. In this case, the variable current circuit 40 functions as current value control means. The variable current circuit 40 includes a current value set circuit 41, a current value comparison circuit 42, and a current value sensor 43. The variable current circuit 40 renders a current value of a pre-fire variable on the basis of temperature. For example, a current value of a pre-fire is set so as to be lower than a current value of a normal fire.

If the temperature is low, the variable current circuit 40 renders the current value of the pre-fire variable so as to be higher than that at the normal temperature. That is, the variable current circuit 40 sets a current value by the current value set circuit 41 such that the current value of the pre-fire becomes higher than the current value of the pre-fire at the normal temperature, and detects a present current value by the current value sensor 43. Then, the variable current circuit 40 maintains the set current value while comparing the detected current value with the set current value by the current value comparison circuit 42. If the temperature is high, the variable current circuit 40 renders the current value of the pre-fire variable so as to be lower than the current value of the pre-fire at the normal temperature. That is, the variable current circuit 40 sets a current value by the current value set circuit 41 such that the current value of the pre-fire becomes lower than the current value of the pre-fire at the normal temperature, and detects a present current value by the current value sensor 43. Then, the variable current circuit 40 maintains the set current value while comparing the detected current value with the set current value by the current value comparison circuit 42. Accordingly, the variable current circuit 40 controls current value such that the higher the temperature detected by the temperature sensor 29 is, the lower the current value of the pre-fire becomes. Thus, the functions of the current value control means are implemented. As a result, the current value of the pre-fire is rendered variable on the basis of the temperature.

Accordingly, an advantageous effect similar to that of the first embodiment can be obtained, and in addition, since the current value of the pre-fire can be varied in response to variation in the temperature, excessive consumption of energy can be prevented. Further, it is possible to stabilize the performance of an impact dot printing head 1 by coping with variation in the temperature.

With the sixth embodiment, the variable current circuit 40 renders the current value of the pre-fire variable on the basis of temperature, however, the scope of the invention is not limited thereto. For example, the variable current circuit 40 may render the current value of the pre-fire variable on the basis of a driving frequency, and further, the variable current circuit 40 may render the current value of the pre-fire variable on the basis of the result of gap detection. An advantageous effect similar to that of the sixth embodiment thereby can be obtained, and it is also possible to stabilize the performance of the impact dot printing head 1 by coping with variation in the driving frequency or the gap. In this connection, the methods of detecting the variable direction of the driving frequency, and detecting the gap, respectively, as described with reference to those other embodiments will suffice for the purpose of operation.

Figure 19:
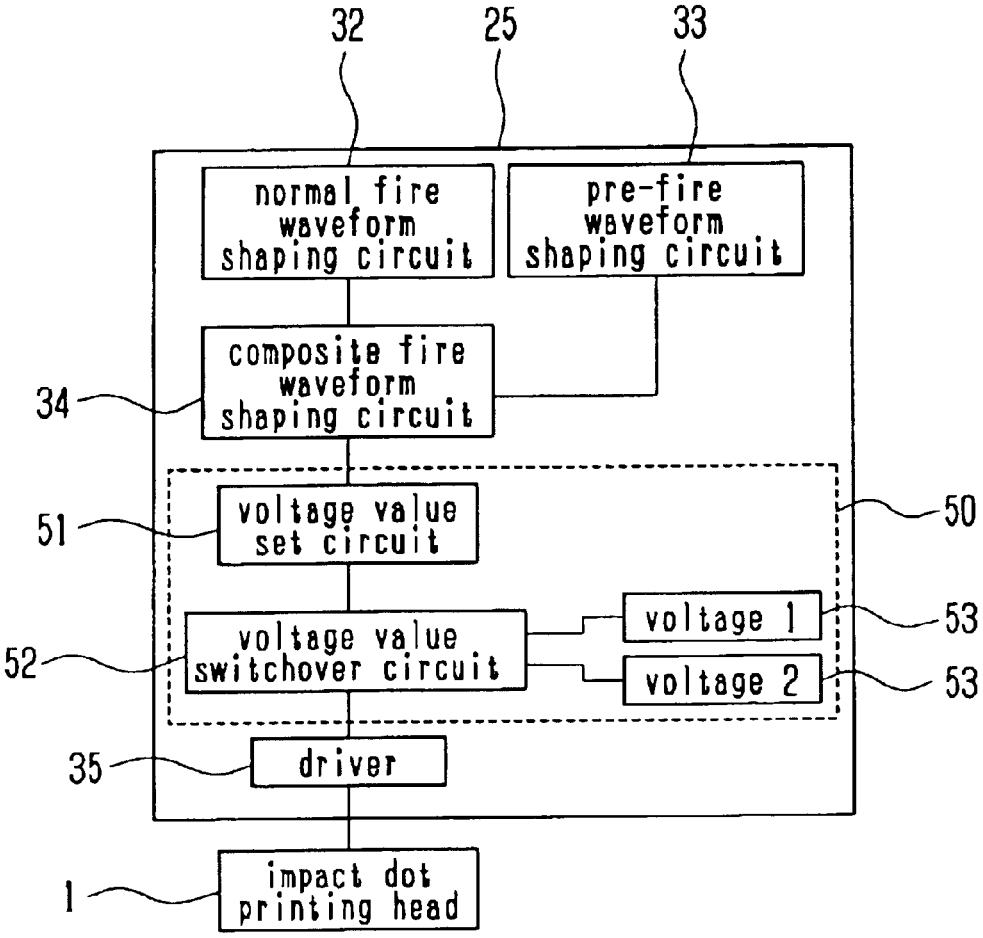
FIG. 19 is a block diagram showing a drive circuit of an impact dot printing head control apparatus according to a variation of the sixth embodiment.

A variation of the sixth embodiment of the invention is described hereinafter with reference to FIG. 19. In the figure, parts corresponding to those for the sixth embodiment are denoted by like reference numerals, omitting description thereof. FIG. 19 is a block diagram showing a drive circuit of an impact dot printing head control apparatus according to the variation of the sixth embodiment of the invention.

Based on a program stored in a ROM 22, temperature detected by a temperature sensor 29 is differentiated by a CPU 21 among three categories, low temperature/normal temperature/high temperature. In this case, the temperature is differentiated among the three categories, however, the scope of the invention is not limited thereto, and the temperature may be differentiated, for example, between only two categories or among four categories.

As shown in FIG. 19, an impact dot printing head drive circuit 25 comprises a variable voltage circuit 50. The variable voltage circuit 50 is installed between a composite fire waveform shaping circuit 34 and a driver 35 to be connected therewith, respectively. In this case, the variable voltage circuit 50 functions as voltage value control means. The variable voltage circuit 50 includes a voltage value set circuit 51, a voltage value switchover circuit 52, and two voltage value registers 53. The variable voltage circuit 50 renders a voltage value of a pre-fire variable on the basis of temperature. For example, the voltage value of the pre-fire is set so as to be lower than a voltage value of a normal fire.

The variable voltage circuit 50 sets a voltage value at the normal temperature by the voltage value set circuit 51. If the temperature is the low temperature, the variable voltage circuit 50 renders the voltage value of the pre-fire variable so as to be higher than the voltage value of the pre-fire at the normal temperature. That is, the variable voltage circuit 50 switches over to a voltage value, higher than the voltage value at the normal temperature, out of two voltage values stored in the two voltage value registers 53, respectively. If the temperature is the high temperature, the variable voltage circuit 50 renders the voltage value of the pre-fire variable so as to be lower than the voltage value of the pre-fire at the normal temperature. That is, the voltage value switchover circuit 52 switches a voltage value over to a voltage value lower than the voltage value at the normal temperature out of the two voltage values stored in the two voltage value registers 53, respectively. Accordingly, the variable voltage circuit 50 controls a voltage value such that the higher the temperature detected by the temperature sensor 29 is, the lower the voltage value of the. pre-fire becomes. Thus, the functions of voltage value control means are implemented. As a result, the voltage value of the pre-fire is rendered variable on the basis of temperature.

Accordingly, an advantageous effect similar to that of the first embodiment can be obtained, and in addition, since the voltage value of the pre-fire can be varied in response to variation in temperature, excessive consumption of energy can be prevented. Further, it is possible to stabilize the performance of an impact dot printing head 1 by coping with variation in temperature.

With the variation of the sixth embodiment, the variable voltage circuit 50 renders the voltage value of the pre-fire variable on the basis of the temperature, however, the scope of the invention is not limited thereto. For example, the variable voltage circuit 50 may render the voltage value of the pre-fire variable on the basis of a driving frequency, and further, the variable voltage circuit 50 may render the voltage value of the pre-fire variable on the basis of the result of gap detection. An advantageous effect similar to that of the variation of the sixth embodiment thereby can be obtained, and it is also possible to stabilize the performance of the impact dot printing head 1 by coping with variation in the driving frequency or the gap. In this connection, the methods of detecting the variable direction of the driving frequency, and detecting the gap, respectively, as described with reference to those other embodiments, will suffice for the purpose of operation.

Obviously, numerous modifications and variations of the present invention are possible in light of the above teachings. It is therefore to be understood that within the scope of the appended claims, the invention may be practiced otherwise than as specifically described herein.

What is claimed is:

1. An impact dot printing head control apparatus, comprising:

normal fire generation means for generating a normal fire for driving wires of an impact dot printing head so as to reach a printing position, respectively, on the basis of printing data and a driving frequency of the impact dot printing head;

pre-fire generation means for generating a pre-fire for driving the wires of the impact dot printing head so as not to reach the printing position, respectively, before the normal fire; and drive control means for implementing the drive control of the respective wires on the basis of the normal fire and the pre-fire, wherein the pre-fire generation means generate the pre-fire at a timing in which the normal fire generation means generate the normal fire while the wires are being driven by the pre-fire.

2. An impact dot printing head control apparatus, comprising:

normal fire generation means for generating a normal fire for driving wires of an impact dot printing head so as to reach a printing position, respectively, on the basis of printing data and a driving frequency of the impact dot printing head;

pre-fire generation means for generating a pre-fire for driving the wires of the impact dot printing head so as not to reach the printing position, respectively, before the normal fire; and drive control means for implementing the drive control of the respective wires on the basis of the normal fire and the pre-fire, wherein the pre-fire generation means generate the pre-fire at a timing in which the normal fire generation means generate the normal fire while the wires are moving in a printing direction by the pre-fire.

3. An impact dot printing head control apparatus, comprising:

normal fire generation means for generating a normal fire for driving wires of an impact dot printing head so as to reach a printing position, respectively, on the basis of printing data and a driving frequency of the impact dot printing head;

pre-fire generation means for generating a pre-fire for driving the wires of the impact dot printing head so as not to reach the printing position, respectively, before the normal fire; and drive control means for implementing the drive control of the respective wires on the basis of the normal fire and the pre-fire, wherein the pre-fire generation means generate the pre-fire at a timing in which the normal fire generation means generate the normal fire while the wires returned to a standby position after driven by the pre-fire are moving in a printing direction due to rebounding.

4. An impact dot printing head control apparatus, comprising:

normal fire generation means for generating a normal fire for driving wires of an impact dot printing head so as to reach a printing position, respectively, on the basis of printing data and a driving frequency of the impact dot printing head;

pre-fire generation means for generating a pre-fire for driving the wires of the impact dot printing head so as not to reach the printing position, respectively, before the normal fire; and drive control means for implementing the drive control of the respective wires on the basis of the normal fire and the pre-fire, further comprising:

temperature detection means for detecting temperature in the vicinity of the impact dot printing head; and fire time control means for controlling fire time such that the higher the temperature detected by the temperature detection means is, the shorter the fire time of the pre-fire is rendered.

5. An impact dot printing head control apparatus, comprising:

normal fire generation means for generating a normal fire for driving wires of an impact dot printing head so as to reach a printing position, respectively, on the basis of printing data and a driving frequency of the impact dot printing head;

pre-fire generation means for generating a pre-fire for driving the wires of the impact dot printing head so as not to reach the printing position, respectively, before the normal fire; and drive control means for implementing the drive control of the respective wires on the basis of the normal fire and the pre-fire, further comprising:

temperature detection means for detecting temperature in the vicinity of the impact dot printing head; and current value control means for controlling current value such that the higher the temperature detected by the temperature detection means is, the lower the current value of the pre-fire is rendered.

6. An impact dot printing head control apparatus, comprising:

normal fire generation means for generating a normal fire for driving wires of an impact dot printing head so as to reach a printing position, respectively, on the basis of printing data and a driving frequency of the impact dot printing head;

pre-fire generation means for generating a pre-fire for driving the wires of the impact dot printing head so as not to reach the printing position, respectively, before the normal fire; and drive control means for implementing the drive control of the respective wires on the basis of the normal fire and the pre-fire, further comprising:

temperature detection means for detecting temperature in the vicinity of the impact dot printing head; and voltage value control means for controlling voltage value such that the higher the temperature detected by the temperature detection means is, the lower the voltage value of the pre-fire is rendered.

7. An impact dot printing head control apparatus, comprising:

normal fire generation means for generating a normal fire for driving wires of an impact dot printing head so as to reach a printing position, respectively, on the basis of printing data and a driving frequency of the impact dot printing head;

pre-fire generation means for generating a pre-fire for driving the wires of the impact dot printing head so as not to reach the printing position, respectively, before the normal fire; and drive control means for implementing the drive control of the respective wires on the basis of the normal fire and the pre-fire, wherein the pre-fire generation means generate the pre-fire plural times immediately before the normal fire, further comprising:

temperature detection means for detecting temperature in the vicinity of the impact dot printing head; and occurrence count control means for controlling the number of pre-fire occurrences such that the higher the temperature detected by the temperature detection means is, the less the number of the pre-fire occurrences is rendered.

8. An impact dot printing head control apparatus, comprising:

normal fire generation means for generating a normal fire for driving wires of an impact dot printing head so as to reach a printing position, respectively, on the basis of printing data and a driving frequency of the impact dot printing head;

pre-fire generation means for generating a pre-fire for driving the wires of the impact dot printing head so as not to reach the printing position, respectively, before the normal fire; and drive control means for implementing the drive control of the respective wires on the basis of the normal fire and the pre-fire, wherein the pre-fire generation means generate the pre-fire plural times in one cycle of the driving frequency, further comprising:

temperature detection means for detecting temperature in the vicinity of the impact dot printing head; and occurrence count control means for controlling the number of pre-fire occurrences such that the higher the temperature detected by the temperature detection means is, the less the number of pre-fire occurrences is rendered.

9. An impact dot printing head control apparatus, comprising:

normal fire generation means for generating a normal fire for driving wires of an impact dot printing head so as to reach a printing position, respectively, on the basis of printing data and a driving frequency of the impact dot printing head;

pre-fire generation means for generating a pre-fire for driving the wires of the impact dot printing head so as not to reach the printing position, respectively, before the normal fire; and drive control means for implementing the drive control of the respective wires on the basis of the normal fire and the pre-fire, further comprising:

driving frequency variable means for rendering the driving frequency variable; and fire time control means for controlling fire time such that the lower the driving frequency as varied by the driving frequency variable means is, the shorter the fire time of the pre-fire is rendered.

10. An impact dot printing head control apparatus, comprising:

normal fire generation means for generating a normal fire for driving wires of an impact dot printing head so as to reach a printing position, respectively, on the basis of printing data and a driving frequency of the impact dot printing head;

pre-fire generation means for generating a pre-fire for driving the wires of the impact dot printing head so as not to reach the printing position, respectively, before the normal fire; and drive control means for implementing the drive control of the respective wires on the basis of the normal fire and the pre-fire, further comprising:

driving frequency variable means for rendering the driving frequency variable; and current value control means for controlling current value such that the lower the driving frequency as varied by the driving frequency variable means is, the lower the current value of the pre-fire is rendered.

11. An impact dot printing head control apparatus, comprising:

normal fire generation means for generating a normal fire for driving wires of an impact dot printing head so as to reach a printing position, respectively, on the basis of printing data and a driving frequency of the impact dot printing head;

pre-fire generation means for generating a pre-fire for driving the wires of the impact dot printing head so as not to reach the printing position, respectively, before the normal fire; and drive control means for implementing the drive control of the respective wires on the basis of the normal fire and the pre-fire, further comprising:

driving frequency variable means for rendering the driving frequency variable; and voltage value control means for controlling voltage value such that the lower the driving frequency as varied by the driving frequency variable means is, the lower the voltage value of the pre-fire is rendered.

12. An impact dot printing head control apparatus, comprising:

normal fire generation means for generating a normal fire for driving wires of an impact dot printing head so as to reach a printing position, respectively, on the basis of printing data and a driving frequency of the impact dot printing head;

pre-fire generation means for generating a pre-fire for driving the wires of the impact dot printing head so as not to reach the printing position, respectively, before the normal fire; and drive control means for implementing the drive control of the respective wires on the basis of the normal fire and the pre-fire, wherein the pre-fire generation means generate the pre-fire plural times immediately before the normal fire, further comprising:

driving frequency variable means for rendering the driving frequency variable; and occurrence count control means for controlling the number of pre-fire occurrences such that the lower the driving frequency as varied by the driving frequency variable means is, the less the number of the pre-fire occurrences is rendered.

13. An impact dot printing head control apparatus, comprising:

normal fire generation means for generating a normal fire for driving wires of an impact dot printing head so as to reach a printing position, respectively, on the basis of printing data and a driving frequency of the impact dot printing head;

pre-fire generation means for generating a pre-fire for driving the wires of the impact dot printing head so as not to reach the printing position, respectively, before the normal fire; and drive control means for implementing the drive control of the respective wires on the basis of the normal fire and the pre-fire, wherein the pre-fire generation means generate the pre-fire plural times in one cycle of the driving frequency, further comprising:

driving frequency variable means for rendering the driving frequency variable; and occurrence count control means for controlling the number of pre-fire occurrences such that the lower the driving frequency as varied by the driving frequency variable means is, the less the number of the pre-fire occurrences is rendered.

14. An impact dot printing head control apparatus, comprising:

normal fire generation means for generating a normal fire for driving wires of an impact dot printing head so as to reach a printing position, respectively, on the basis of printing data and a driving frequency of the impact dot printing head;

pre-fire generation means for generating a pre-fire for driving the wires of the impact dot printing bead so as not to reach the printing position, respectively, before the normal fire; and drive control means for implementing the drive control of the respective wires on the basis of the normal fire and the pre-fire, further comprising:

gap detection means for detecting a gap between the impact dot printing head and a platen; and fire time control means for controlling fire time such that the narrower the gap detected by the gap detection means is, the shorter the fire time of the pre-fire is rendered.

15. An impact dot printing head control apparatus, comprising:

normal fire generation means for generating a normal fire for driving wires of an impact dot printing head so as to reach a printing position, respectively, on the basis of printing data and a driving frequency of the impact dot printing head;

pre-fire generation means for generating a pre-fire for driving the wires of the impact dot printing head so as not to reach the printing position, respectively, before the normal fire; and drive control means for implementing the drive control of the respective wires on the basis of the normal fire and the pre-fire, further comprising:

gap detection means for detecting a gap between the impact dot printing head and a platen; and current value control means for controlling current value such that the narrower the gap detected by the gap detection means is, the lower the current value of the pre-fire is rendered.

16. An impact dot printing head control apparatus, comprising:

normal fire generation means for generating a normal fire for driving wires of an impact dot printing head so as to reach a printing position, respectively, on the basis of printing data and a driving frequency of the impact dot printing head;

pre-fire generation means for generating a pre-fire for driving the wires of the impact dot printing head so as not to reach the printing position, respectively, before the normal fire; and drive control means for implementing the drive control of the respective wires on the basis of the normal fire and the pre-fire, further comprising:

gap detection means for detecting a gap between the impact dot printing head and a platen; and voltage value control means for controlling voltage value such that the narrower the gap detected by the gap detection means is, the lower the voltage value of the pre-fire is rendered.

17. An impact dot printing head control apparatus, comprising:

normal fire generation means for generating a normal fire for driving wires of an impact dot printing head so as to reach a printing position, respectively, on the basis of printing data and a driving frequency of the impact dot printing head;

pre-fire generation means for generating a pre-fire for driving the wires of the impact dot printing head so as not to reach the printing position, respectively, before the normal fire; and drive control means for implementing the drive control of the respective wires on the basis of the normal fire and the pre-fire, wherein the pre-fire generation means generate the pre-fire plural times immediately before the normal fire, further comprising:

gap detection means for detecting a gap between the impact dot printing head and a platen; and occurrence count control means for controlling the number of pre-fire occurrences such that the narrower the gap detected by the gap detection means, the less the number of the pre-fire occurrences is rendered.

18. An impact dot printing head control apparatus, comprising:

normal fire generation means for generating a normal fire for driving wires of an impact dot printing head so as to reach a printing position, respectively, on the basis of printing data and a driving frequency of the impact dot printing head;

pre-fire generation means for generating a ore-fire for driving the wires of the impact dot printing head so as not to reach the printing position, respectively, before the normal fire; and drive control means for implementing the drive control of the respective wires on the basis of the normal fire and the ore-fire, wherein the pre-fire generation means generate the pre-fire plural times in one cycle of the driving frequency, further comprising:

gap detection means for detecting a gap between the impact dot printing head and a platen; and occurrence count control means for controlling the number of pre-fire occurrences such that the narrower the gap detected by the gap detection means is, the less the number of the pre-fire occurrences is rendered.

* * * * *